US009121169B2

(12) United States Patent
Hohmann, Jr.

(10) Patent No.: US 9,121,169 B2
(45) Date of Patent: Sep. 1, 2015

(54) VENEER TIE AND WALL ANCHORING SYSTEMS WITH IN-CAVITY CERAMIC AND CERAMIC-BASED THERMAL BREAKS

(71) Applicant: MITEK HOLDINGS, INC., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 13/935,142

(22) Filed: Jul. 3, 2013

(65) Prior Publication Data

US 2015/0007520 A1 Jan. 8, 2015

(51) Int. Cl.

| | |
|---|---|
| ***E04B 1/38*** | (2006.01) |
| ***E04B 1/41*** | (2006.01) |
| ***E04B 1/76*** | (2006.01) |

(52) U.S. Cl.

CPC ..... *E04B 1/4178* (2013.01); *E04B 1/7637* (2013.01); *E04B 1/7616* (2013.01)

(58) Field of Classification Search

CPC .... E04B 1/4178; E04B 1/7616; E04B 1/7637
USPC ..... 52/513, 712, 713, 379
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| RE15,979 | E | 1/1925 | Schaefer et al. |
| 1,794,684 | A | 3/1931 | Handel |
| 1,936,223 | A | 11/1933 | Awbrey |
| 2,058,148 | A | 10/1936 | Hard |

(Continued)

FOREIGN PATENT DOCUMENTS

| | | |
|---|---|---|
| CH | 279209 | 3/1952 |
| EP | 0199595 B1 | 3/1995 |

(Continued)

OTHER PUBLICATIONS

State Board of Building Regulations and Standards, Building Envelope Requirements, 780 CMR sec. 1304.0 et seq., 7th Edition, Aug. 22, 2008, 11 pages, Boston, MA, United States.

(Continued)

*Primary Examiner* — Brian Glessner
*Assistant Examiner* — Joshua Ihezie
(74) *Attorney, Agent, or Firm* — Silber & Fridman

(57) ABSTRACT

Thermally-isolating veneer ties and anchoring systems employing the same are disclosed. A ceramic based thermally-isolating coating is applied to the veneer tie, which is interconnected with a sheetmetal surface-mounted wall anchor. The thermally-isolating ceramic coating is selected from a distinct grouping of materials, that are applied using a specific variety of methods, in one or more layers and cured and cross-linked to provide high-strength adhesion. The ceramic coating maintains a thermal expansion similar to that of the underlying wire formative to prevent cracking. The thermally-coated veneer ties provide an in-cavity thermal break that severs the thermal threads running throughout the cavity wall structure, reducing the U- and K-values of the anchoring system by thermally-isolating the metal components.

19 Claims, 7 Drawing Sheets

(56) References Cited

U.S. PATENT DOCUMENTS 2,097,821 A 11/1937 Mathers
2,280,647 A 4/1942 Hawes
2,300,181 A 10/1942 Spaight
2,343,764 A 3/1944 Fuller
2,403,566 A 7/1946 Thorp et al.
2,413,772 A 1/1947 Morehouse
2,605,867 A 8/1952 Goodwin
2,780,936 A 2/1957 Hillberg
2,898,758 A 8/1959 Henrickson
2,929,238 A 3/1960 Kaye
2,966,705 A 1/1961 Massey
2,999,571 A 9/1961 Huber
3,030,670 A 4/1962 Bigelow
3,088,361 A 5/1963 Hallock
3,183,628 A 5/1965 Smith
3,254,736 A 6/1966 Gass
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,440,922 A 4/1969 Cohen
3,478,480 A 11/1969 Swenson
3,529,508 A 9/1970 Cooksey
3,563,131 A 2/1971 Ridley, Sr.
3,568,389 A 3/1971 Gulow
3,640,043 A 2/1972 Querfeld et al.
3,925,996 A 12/1975 Wiggill
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,281,494 A 8/1981 Weinar
4,305,239 A 12/1981 Geraghty
4,373,314 A 2/1983 Allan
4,382,416 A 5/1983 Kellogg-Smith
4,410,760 A 10/1983 Cole
4,424,745 A 1/1984 Magorian et al.
4,438,611 A 3/1984 Bryant
4,473,984 A 10/1984 Lopez
4,482,368 A 11/1984 Roberts
4,571,909 A 2/1986 Berghuis et al.
4,596,102 A 6/1986 Catani et al.
4,598,518 A 7/1986 Hohmann
4,606,163 A 8/1986 Catani
4,622,796 A 11/1986 Aziz et al.
4,628,657 A 12/1986 Ermer et al.
4,636,125 A 1/1987 Burgard
4,640,848 A * 2/1987 Cerdan-Diaz et al. ..... 427/426
4,660,342 A 4/1987 Salisbury
4,688,363 A 8/1987 Sweeney et al.
4,703,604 A 11/1987 Muller
4,708,551 A 11/1987 Richter et al.
4,714,507 A 12/1987 Ohgushi
4,723,866 A 2/1988 McCauley
4,738,070 A 4/1988 Abbott et al.
4,757,662 A 7/1988 Gasser
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A 5/1990 Kramer et al.
4,923,348 A 5/1990 Carlozzo et al.
4,946,632 A 8/1990 Pollina
4,948,319 A 8/1990 Day et al.
4,955,172 A 9/1990 Pierson
4,993,902 A 2/1991 Hellon
5,063,722 A 11/1991 Hohmann
5,099,628 A 3/1992 Noland et al.
5,207,043 A * 5/1993 McGee et al. ..... 52/379
5,307,602 A 5/1994 Lebraut
5,392,581 A 2/1995 Hatzinikolas et al.
5,395,196 A 3/1995 Notaro
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,518,351 A 5/1996 Peil
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A * 5/1998 Hohmann ..... 52/489.1
5,816,008 A 10/1998 Hohmann
5,819,486 A 10/1998 Goodings
5,845,455 A 12/1998 Johnson, III
6,000,178 A 12/1999 Goodings
6,125,608 A 10/2000 Charlson
6,176,662 B1 1/2001 Champney et al.
6,209,281 B1 4/2001 Rice
6,279,283 B1 8/2001 Hohmann et al.
6,284,311 B1 9/2001 Gregorovich et al.
6,293,744 B1 9/2001 Hempfling et al.
6,332,300 B1 12/2001 Wakai
6,351,922 B1 3/2002 Burns et al.
6,367,219 B1 4/2002 Quinlan
6,548,190 B2 4/2003 Spitsberg et al.
6,612,343 B2 9/2003 Camberlin et al.
6,627,128 B1 9/2003 Boyer
6,668,505 B1 12/2003 Hohmann et al.
6,686,301 B2 2/2004 Li et al.
6,709,213 B2 3/2004 Bailey
6,718,774 B2 4/2004 Razzell
6,735,915 B1 5/2004 Johnson, III
6,739,105 B2 5/2004 Fleming
6,789,365 B1 9/2004 Hohmann et al.
6,812,276 B2 11/2004 Yeager
6,817,147 B1 11/2004 MacDonald
6,827,969 B1 * 12/2004 Skoog et al. ..... 427/142
6,837,013 B2 1/2005 Foderberg et al.
6,851,239 B1 2/2005 Hohmann et al.
6,918,218 B2 7/2005 Greenway
6,925,768 B2 * 8/2005 Hohmann et al. ..... 52/513
6,941,717 B2 * 9/2005 Hohmann et al. ..... 52/506.01
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 2/2008 Hohmann, Jr. et al.
7,334,374 B2 2/2008 Schmid
7,374,825 B2 * 5/2008 Hazel et al. ..... 428/632
7,415,803 B2 8/2008 Bronner
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,735,292 B2 6/2010 Massie
7,744,321 B2 6/2010 Wells
7,748,181 B1 7/2010 Guinn
7,788,869 B2 9/2010 Voegele, Jr.
D626,817 S 11/2010 Donowho et al.
7,845,137 B2 * 12/2010 Hohmann, Jr. ..... 52/714
7,918,634 B2 4/2011 Conrad et al.
8,037,653 B2 10/2011 Hohmann, Jr.
8,051,619 B2 11/2011 Hohmann, Jr.
8,096,090 B1 1/2012 Hohmann, Jr. et al.

(56) References Cited

U.S. PATENT DOCUMENTS

| | | | | |
|---|---|---|---|---|
| 8,109,706 | B2 | 2/2012 | Richards | |
| 8,122,663 | B1 | 2/2012 | Hohmann, Jr. et al. | |
| 8,201,374 | B2 | 6/2012 | Hohmann, Jr. | |
| 8,209,934 | B2 | 7/2012 | Pettingale | |
| 8,215,083 | B2 | 7/2012 | Toas et al. | |
| 8,291,672 | B2 | 10/2012 | Hohmann, Jr. | |
| 8,347,581 | B2 | 1/2013 | Doerr et al. | |
| 8,375,667 | B2 | 2/2013 | Hohmann, Jr. | |
| 8,418,422 | B2 | 4/2013 | Johnson, III | |
| 8,511,041 | B2 | 8/2013 | Fransen | |
| 8,516,763 | B2 | 8/2013 | Hohmann, Jr. | |
| 8,516,768 | B2 | 8/2013 | Johnson, III | |
| 8,544,228 | B2 | 10/2013 | Bronner | |
| 8,555,587 | B2 | 10/2013 | Hohmann, Jr. | |
| 8,555,596 | B2 | 10/2013 | Hohmann, Jr. | |
| 8,596,010 | B2 | 12/2013 | Hohmann, Jr. | |
| 8,609,224 | B2 | 12/2013 | Li et al. | |
| 8,613,175 | B2 | 12/2013 | Hohmann, Jr. | |
| 8,667,757 | B1 * | 3/2014 | Hohmann, Jr. | 52/513 |
| 8,863,460 | B2 * | 10/2014 | Hohmann, Jr. | 52/513 |
| 8,920,092 | B2 | 12/2014 | D'Addario et al. | |
| 2001/0054270 | A1 | 12/2001 | Rice | |
| 2002/0047488 | A1 | 4/2002 | Webb et al. | |
| 2002/0100239 | A1 * | 8/2002 | Lopez | 52/379 |
| 2003/0121226 | A1 | 7/2003 | Bolduc | |
| 2003/0217521 | A1 | 11/2003 | Richardson et al. | |
| 2004/0083667 | A1 | 5/2004 | Johnson, III | |
| 2004/0187421 | A1 | 9/2004 | Johnson, III | |
| 2004/0216408 | A1 * | 11/2004 | Hohmann, Jr. | 52/426 |
| 2004/0216413 | A1 * | 11/2004 | Hohmann et al. | 52/506.01 |
| 2004/0216416 | A1 * | 11/2004 | Hohmann et al. | 52/513 |
| 2004/0231270 | A1 | 11/2004 | Collins et al. | |
| 2005/0046187 | A1 | 3/2005 | Takeuchi et al. | |
| 2005/0129485 | A1 | 6/2005 | Swim, Jr. | |
| 2005/0279043 | A1 | 12/2005 | Bronner | |
| 2006/0198717 | A1 | 9/2006 | Fuest | |
| 2006/0242921 | A1 | 11/2006 | Massie | |
| 2006/0251916 | A1 * | 11/2006 | Arikawa et al. | 428/632 |
| 2007/0011964 | A1 * | 1/2007 | Smith | 52/285.3 |
| 2007/0059121 | A1 | 3/2007 | Chien | |
| 2008/0141605 | A1 | 6/2008 | Hohmann | |
| 2008/0166203 | A1 | 7/2008 | Reynolds et al. | |
| 2008/0222992 | A1 | 9/2008 | Hikai et al. | |
| 2009/0133351 | A1 | 5/2009 | Wobber | |
| 2009/0133357 | A1 | 5/2009 | Richards | |
| 2010/0037552 | A1 | 2/2010 | Bronner | |
| 2010/0071307 | A1 * | 3/2010 | Hohmann, Jr. | 52/714 |
| 2010/0101175 | A1 | 4/2010 | Hohmann | |
| 2010/0192495 | A1 | 8/2010 | Huff | |
| 2011/0023748 | A1 * | 2/2011 | Wagh et al. | 106/18.14 |
| 2011/0041442 | A1 | 2/2011 | Bui | |
| 2011/0047919 | A1 | 3/2011 | Hohmann, Jr. | |
| 2011/0061333 | A1 * | 3/2011 | Bronner | 52/712 |
| 2011/0083389 | A1 | 4/2011 | Bui | |
| 2011/0146195 | A1 | 6/2011 | Hohmann, Jr. | |
| 2011/0173902 | A1 | 7/2011 | Hohmann et al. | |
| 2011/0189480 | A1 | 8/2011 | Hung | |
| 2011/0277397 | A1 | 11/2011 | Hohmann, Jr. | |
| 2012/0186183 | A1 | 7/2012 | Johnson, III | |
| 2012/0304576 | A1 | 12/2012 | Hohmann, Jr. | |
| 2012/0308330 | A1 * | 12/2012 | Hohmann, Jr. | 411/387.1 |
| 2013/0008121 | A1 | 1/2013 | Dalen | |
| 2013/0074435 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |
| 2014/0075855 | A1 | 3/2014 | Hohmann, Jr. | |
| 2014/0075856 | A1 | 3/2014 | Hohmann, Jr. | |
| 2014/0075879 | A1 | 3/2014 | Hohmann, Jr. | |
| 2014/0096466 | A1 | 4/2014 | Hohmann, Jr. | |
| 2014/0174013 | A1 | 6/2014 | Hohmann, Jr. et al. | |
| 2014/0202098 | A1 * | 7/2014 | De Smet et al. | 52/309.16 |
| 2014/0215958 | A1 * | 8/2014 | Duyvejonck et al. | 52/713 |
| 2014/0250826 | A1 * | 9/2014 | Hohmann, Jr. | 52/714 |

FOREIGN PATENT DOCUMENTS

| | | |
|---|---|---|
| GB | 1575501 | 9/1980 |
| GB | 2069024 A | 8/1981 |
| GB | 2246149 A | 1/1992 |
| GB | 2265164 A | 9/1993 |
| GB | 2459936 A | 3/2013 |

OTHER PUBLICATIONS

Hohmann & Barnard, Product Catalog, 44 pgs (2003).

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

Building Envelope Requirements, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 2011, 12 pages.

Hohmann & Barnard, Inc.; Product Catalog, 2013, 52 pages, Hauppauge, New York, United States.

Effect of Insulation and Mass Distribution in Exterior Walls on Dynamic Thermal Performance of Whole Buildings, Jan Kosny, Ph.D, Elisabeth Kossecka, Ph.D., Thermal Envelopes VII/Building Systems—Principles p. 721-731, 1998, 11 pages.

ASTM Standard A-951, Standard Specification for Steel Wire for Masonry Joint Reinforcement, Table 1, 2011, 6 pages.

* cited by examiner

VENEER TIE AND WALL ANCHORING SYSTEMS WITH IN-CAVITY CERAMIC AND CERAMIC-BASED THERMAL BREAKS

BACKGROUND OF THE INVENTION

1. Field of the Invention

This invention relates to thermally-coated veneer ties and associated anchors and anchoring systems for cavity walls. More particularly, the invention relates to anchoring systems with veneer ties having a thermally-isolating ceramic or ceramic-based coating and associated components made largely of thermally conductive metals. The system has application to seismic-resistant structures and to cavity walls requiring thermal isolation.

2. Description of the Prior Art

The move toward more energy-efficient insulated cavity wall structures has led to the need to create a thermally-isolated building envelope which separates the interior environment and the exterior environment of a cavity wall structure. The building envelope, while primarily designed to maintain structural integrity, is further designed to: (1) control temperature; (2) minimize thermal transfer between the wythes; and (3) remove moisture from the cavity. Insulation is used within the building envelope to reduce thermal transfer thereacross, maintain temperature and restrict the formation of condensate within the cavity. When the prior art metal anchoring systems are used, the integrity of the insulation is compromised. Such systems are constructed from thermally conductive metals that result in thermal transfer between and through the wythes. The use of the specially designed and thermally-protected veneer ties of the present invention lower the veneer tie thermal conductivities, provide an in-cavity thermal break, and thereby reduce thermal transfer.

When a cavity wall is constructed and a thermal envelope created, hundreds, if not thousands, of wall anchors and associated ties are inserted throughout the cavity wall. Each anchor and tie combination forms a thermal bridge perforating the insulation and moisture barriers within the cavity wall structure. While seals at the insertion locations deter water and vapor entry, unwanted thermal gains and loss still result. Further, when each individual anchoring systems is interconnected veneer-tie-to-wall-tie, a thermal thread results stretching across the cavity and extending between the inner wythe to the outer wythe. Failure to isolate the steel components and break the thermal transfer, results in heating and cooling losses and potentially damaging condensation buildup within the cavity wall structure. Such condensation buildups provide a medium for corrosion and mold growth. The use of thermally-isolating coated veneer ties removes the thermal bridges and breaks the thermal thread. This results in a building envelope having more efficient insulative properties, a thermally-isolated anchoring system, and improved condensate control.

The present invention provides a thermally-isolating coated veneer tie specially-suited for use within a cavity wall. Anchoring systems within cavity walls are subject to outside forces such as earthquakes and wind shear that cause abrupt movement within the cavity wall. Additionally, any materials placed within the cavity wall require the characteristics of low flammability and, upon combustion, the release of combustion products with low toxicity. The present invention provides a coating suited to such requirements, which, besides meeting the flammability/toxicity standards, includes characteristics such as shock resistance, non-frangibility, thermal expansion similar to the underlying metals, low thermal conductivity and transmissivity, and a non-porous resilient finish.

This unique combination of characteristics provides a veneer tie well-suited for installation within a cavity wall anchoring system.

In the past, anchoring systems have taken a variety of configurations. Where the applications included masonry backup walls, wall anchors were commonly incorporated into ladder—or truss-type reinforcements and provided wire-to-wire connections with box-ties or pintle-receiving designs on the veneer side.

In the late 1980's, surface-mounted wall anchors were developed by Hohmann & Barnard, Inc., now a MiTEK-Berkshire Hathaway Company, and patented under U.S. Pat. No. 4,598,518. The invention was commercialized under trademarks DW-10®, DW-10-X®, and DW-10-HS®. These widely accepted building specialty products were designed primarily for dry-wall construction, but were also used with masonry backup walls. For seismic applications, it was common practice to use these wall anchors as part of the DW-10® Seismiclip® interlock system which added a Byna-Tie® wire formative, a Seismiclip® snap-in device—described in U.S. Pat. No. 4,875,319 ('319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of more rigorous specifications by which tension and compression characteristics were raised, a different structure—such as one of those described in detail below—became necessary.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for disposition in a bed joint of the outer wythe. It is instructive to note that pin-point loading—that is forces concentrated at substantially a single point—developed from this design configuration. This resulted, upon experiencing lateral forces over time, in the loosening of the stud.

There have been significant shifts in public sector building specifications, such as the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe, which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜ inch high space in the inner wythe and tie down a veneer facing material of an outer wythe at a span of two or more times that which had previously been experienced.

As insulation became thicker, the tearing of insulation during installation of the pronged DW-10X® wall anchor, see infra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater insulation integrity and less reliance on a patch.

As concerns for thermal transfer and resulting heat loss/gain and the buildup of condensation within the cavity wall grew, focus turned to thermal isolation and breaks. Another prior art development occurred in an attempt to address thermal transfer shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results. Further reductions in thermal transfer were accomplished through the BynaTie® system ('319) which provides a bail handle with pointed legs and a dual sealing arrangement, U.S. Pat. No. 8,037,653. While each prior art invention reduced thermal transfer, neither development provided more complete thermal protection through the use of a specialized thermally-isolating coated veneer tie, which removes thermal bridging and improves thermal insulation through the use of a thermal barrier. The presently presented thermal tie is optionally low profile with a matte-finish coating to provide greater pullout resistance.

Focus on the thermal characteristics of cavity wall construction is important to ensuring minimized heat transfer through the walls, both for comfort and for energy efficiency of heating and air conditioning. When the exterior is cold relative to the interior of a heated structure, heat from the interior should be prevented from passing through the outside. Similarly, when the exterior is hot relative to the interior of an air conditioned structure, heat from the exterior should be prevented from passing through to the interior. The main cause of thermal transfer is the use of anchoring systems made largely of metal, either steel wire formatives, or metal plate components, that are thermally conductive. While providing the required high-strength within the cavity wall system, the use of steel components results in heat transfer.

Another application for anchoring systems is in the evolving technology of self-cooling buildings. Here, the cavity wall serves additionally as a plenum for delivering air from one area to another. The ability to size cavities to match air moving requirements for naturally ventilated buildings enable the architectural engineer to now consider cavity walls when designing structures in this environmentally favorable form.

Building thermal stability within a cavity wall system requires the ability to hold the internal temperature of the cavity wall within a certain interval. This ability helps to prevent the development of cold spots, which act as gathering points for condensation. Through the use of a thermally-isolating coating, the veneer tie obtains a lower transmission (U-value) and thermal conductive value (K-value) and provides non-corrosive benefits. The present invention maintains the strength of the veneer tie and further provides the benefits of a thermal break in the cavity.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. This led to the low-profile wall anchors of the inventors hereof as described in U.S. Pat. No. 6,279,283. However, the above-described technology did not address the adaption thereof to surface mounted devices. The combination of each individual tie linked together in a cavity wall setting creates a thermal thread throughout the structure, thereby raising thermal conductivity and reducing the effectiveness of the insulation. The present invention provides a thermal break which interrupts and restricts thermal transfer.

In the course of preparing this Application, several patents, became known to the inventors hereof and are acknowledged hereby:

| Pat. | Inventor | Issue Date |
|---|---|---|
| 4,021,990 | Schwalberg | May, 1977 |
| 4,373,314 | Allan | February, 1983 |
| 4,473,984 | Lopez | December, 1984 |
| 4,875,319 | Hohmann | October, 1989 |
| 5,392,581 | Hatzinikolas et al. | February, 1995 |
| 5,456,052 | Anderson et al. | October, 1995 |
| 5,816,008 | Hohmann | October, 1998 |

-continued

| Pat. | Inventor | Issue Date |
|---|---|---|
| 6,209,281 | Rice | April, 2001 |
| 6,279,283 | Hohmann et al. | August, 2001 |

U.S. Pat. No. 4,021,990—B. J. Schwalber—Issued May 10, 1977

Discloses a dry wall construction system for anchoring a facing veneer to wallboard/metal stud construction with a pronged sheetmetal anchor.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,879,319—R. Hohmann—Issued Oct. 24, 1989

Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,392,581—Hatzinikolas et al.—Issued Feb. 28, 1995

Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,456,052—Anderson et al. —Issued Oct. 10, 1995

Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998

Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Issued Apr. 3, 2001

Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001

Discloses a low-profile wall tie primarily for use in renovation construction where in order to match existing mortar height in the facing wythe a compressed wall tie is embedded in the bed joint of the brick veneer.

None of the above provide a thermally-isolating ceramic or ceramic-based coated anchoring system that maintains the thermal isolation of a building envelope. As will become clear in reviewing the disclosure which follows, the cavity wall structure benefits from the recent developments described herein that lead to solving the problems of thermal insulation and heat transfer within the cavity wall. The veneer tie is modifiable for use with various style wall anchors allowing for interconnection in varied cavity wall structures. The prior art does not provide the present novel cavity wall construction system as described herein below.

SUMMARY

In general terms, the invention disclosed hereby is a high-strength thermally-isolating surface-mounted anchoring system for use in a cavity wall structure with a unique ceramic or ceramic-based thermally-coated veneer tie that is interconnected with varied surface mounted wall anchors. The wall anchor is a sheetmetal device which is described herein as functioning with a thermally-coated formative veneer tie. The wall anchor provides a sealing effect precluding the penetration of air, moisture, and water vapor into the inner wythe structure. In all of the embodiments shown, the legs are formed to fully or partially sheath the mounting hardware of the wall anchor. The sheathing function reduces the openings in the insulation required for installing the wall anchor.

The veneer tie is composed of an attachment portion, two cavity portions and an insertion portion. The attachment portion and, optionally, the two cavity portions and/or the insertion portion receive a ceramic or ceramic-based, thermally-isolating coating. The thermally-isolating coating is selected from a distinct grouping of materials that are applied using a specific variety of methods, in one or more layers which are cured and cross-linked to provide high-strength adhesion. The thermally-isolating coating has a thermal expansion similar to the underlying wire formative to prevent cracking. A matte finish is optionally provided to form a high-strength, pullout resistant installation in the bed joint. The thermally-coated veneer ties provide an in-cavity thermal break that interrupts the thermal conduction in the anchoring system threads running throughout the cavity wall structure. The thermal coating reduces the U- and K-values of the anchoring system by thermally-isolating the metal components.

The veneer tie insertion portion is optionally compressed to provide a high-strength interconnection with the outer wythe. For seismic structures, the insertion portion is swaged or compressed to interconnect with a reinforcement wire. The anchoring systems are utilizable with either a dry wall or masonry inner wythe.

It is an object of the present invention to provide a new and novel anchoring systems for cavity walls, which systems contain a ceramic coated veneer tie that is thermally isolating.

It is another object of the present invention to provide a new and novel high-strength veneer tie which is thermally coated with a thermally-isolating ceramic compound that reduces the U- and K-values of the anchoring system.

It is yet another object of the present invention to provide in an anchoring system having an inner wythe and an outer wythe, a low profile, high-strength veneer tie that interengages a wall anchor.

It is still yet another object of the present invention to provide an anchoring system which is constructed to maintain insulation integrity within the building envelope by providing a thermal break.

It is a feature of the present invention that the wall anchor hereof provides thermal isolation of the anchoring systems.

It is another feature of the present invention that the anchoring system is utilizable with either a masonry block having aligned or unaligned bed joints or with a dry wall construct that secures to a metal stud.

It is yet another feature of the present invention that the low profile veneer tie securely holds to the mortar joint and prevents pullout.

It is another feature of the present invention that the coated veneer tie provides an in-cavity thermal break.

It is a further feature of the present invention that the veneer tie coating maintains a thermal expansion similar to the underlying wire formative and is shock resistant, resilient, and noncombustible.

Other objects and features of the invention will become apparent upon review of the drawings and the detailed description which follows.

BRIEF DESCRIPTION OF THE DRAWINGS

In the following drawings, the same parts in the various views are afforded the same reference designators.

DESCRIPTION OF THE PREFERRED EMBODIMENTS

Figure 1:
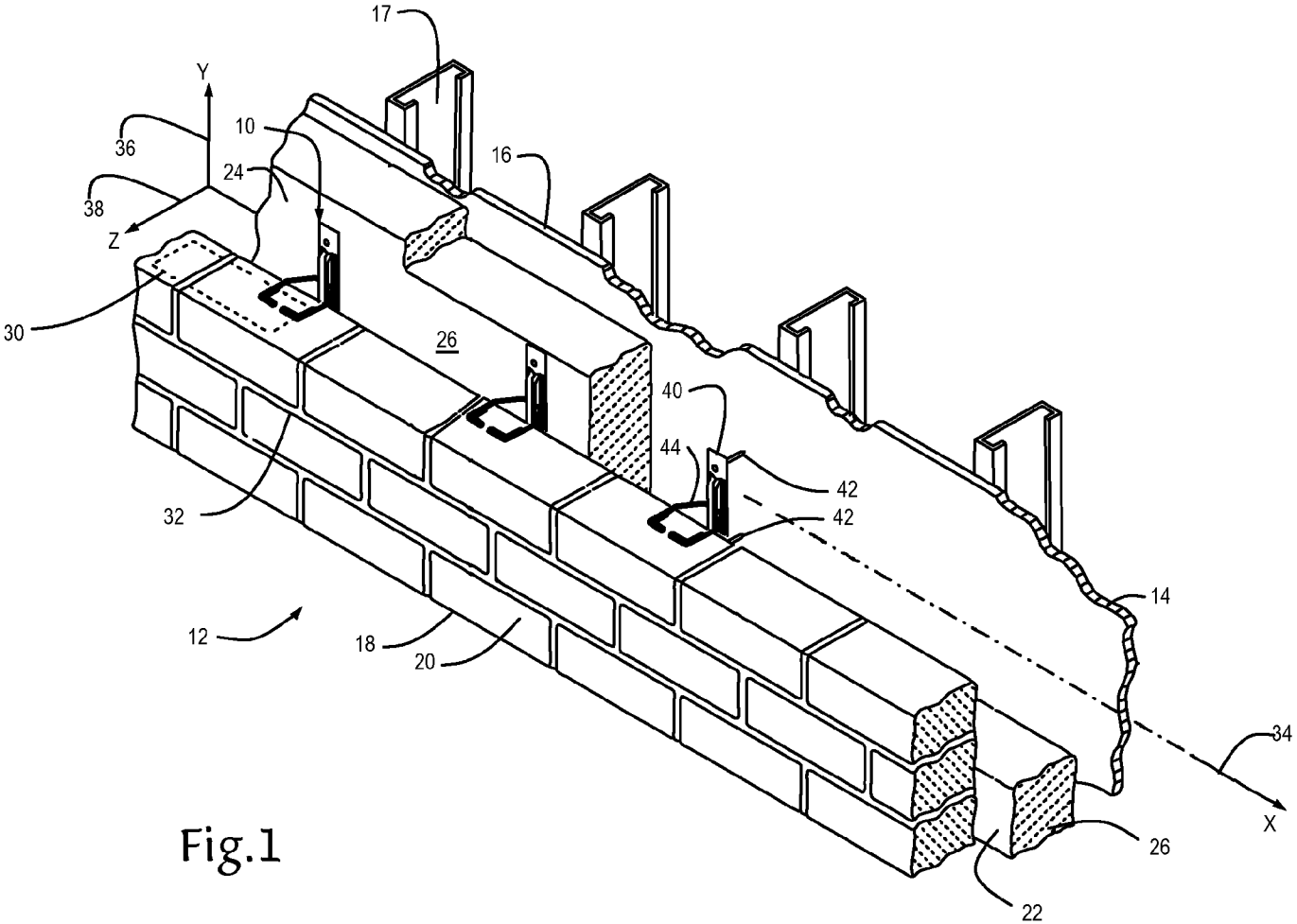
FIG. 1 shows a first embodiment of this invention and is a perspective view of a surface-mounted anchoring system with a thermally-isolating veneer tie, as applied to a cavity wall with an inner wythe of dry wall construction with insulation disposed on the cavity-side thereof and an outer wythe of brick, the veneer tie insertion portion is compressively reduced.

Before entering into the detailed Description of the Preferred Embodiments, several terms which will be revisited later are defined. These terms are relevant to discussions of innovations introduced by the improvements of this disclosure that overcome the technical shortcoming of the prior art devices.

In the embodiments described hereinbelow, the inner wythe is optionally provided with insulation and/or a waterproofing membrane. In the cavity wall construction shown in the embodiments hereof, this takes the form of exterior insulation disposed on the outer surface of the inner wythe. Recently, building codes have required that after the anchoring system is installed and, prior to the inner wythe being closed up, that an inspection be made for insulation integrity to ensure that the insulation prevents infiltration of air and moisture. Here the term insulation integrity is used in the same sense as the building code in that, after the installation of the anchoring system, there is no change or interference with the insulative properties and concomitantly substantially no change in the air and moisture infiltration characteristics.

In a related sense, prior art sheetmetal anchors have formed a conductive bridge between the wall cavity and the interior of the building. Here the terms thermal conductivity and thermal conductivity analysis are used to examine this phenomenon and the metal-to-metal contacts across the inner wythe. The present anchoring system severs the conductive bridge and interrupts the thermal pathway created throughout the cavity wall by the metal components, including a reinforcement wire which provides a seismic structure. Failure to isolate the metal components of the anchoring system and break the thermal transfer results in heating and cooling losses and in potentially damaging condensation buildup within the cavity wall structure.

In addition to that which occurs at the facing wythe, attention is further drawn to the construction at the exterior surface of the inner or backup wythe. Here there are two concerns. namely, maximizing the strength of the securement of the surface-mounted wall anchor to the backup wall and, as previously discussed minimizing the interference of the anchoring system with the insulation and the waterproofing. The first concern is addressed using appropriate fasteners such as, for mounting to metal, dry-wall studs, self-tapping screws. The latter concern is addressed by the flatness of the base of the surface-mounted, folded anchors covering the openings formed by the legs and by the notched leg portion minimizing the openings in the components of the inner wythe and the thermally-isolating veneer tie.

In the detailed description, the veneer reinforcements and the veneer ties are thermally-coated wire formatives. The wire used in the fabrication of veneer joint reinforcement conforms to the requirements of ASTM Standard Specification A951-00, Table 1. For the purpose of this application tensile strength tests and yield tests of veneer joint reinforcements are, where applicable, those denominated in ASTM A-951-00 Standard Specification for Masonry Joint Reinforcement.

The thermal stability within the cavity wall maintains the internal temperature of the cavity wall within a certain interval. Through the use of the presently described thermally-isolating coating, the veneer tie, obtains a lower transmission (U-value) and thermal conductive value (K-value), providing a high strength anchor with the benefits of thermal isolation. The term K-value is used to describe the measure of heat conductivity of a particular material, i.e., the measure of the amount of heat, in BTUs per hour, that will be transmitted through one square foot of material that is one inch thick to cause a temperature change of one degree Fahrenheit from one side of the material to the other. The lower the K-value, the better the performance of the material as an insulator. The wire formatives comprising the components of the anchoring systems generally have a K-value range of 16 to 116 W/m K. The thermal coating disposed on the veneer tie of this invention greatly reduces such K-values of the veneer tie to a low thermal conductive (K-value) not to exceed 1 W/m K. Similar to the K-value, a low thermal transmission value (U-value) is important to the thermal integrity of the cavity wall. The term U-value is used to describe a measure of heat loss in a building component. It can also be referred to as an overall heat transfer co-efficient and measures how well parts of a building transfer heat. The higher the U-value, the worse the thermal performance of the building envelope. Low thermal transmission or U-value is defined as not to exceed 0.35 $W/m^2K$ for walls. The U-value is calculated from the reciprocal of the combined thermal resistances of the materials in the cavity wall, taking into account the effect of thermal bridges, air gaps and fixings.

The thermally-isolating coating of this invention is a ceramic or ceramic-based coating with a thermal expansion substantially similar to the thermal expansion of the underlying wire formative to prevent cracking and flaking of the thermal coating. Beyond the thermally insulative benefits of the present invention, the thermal coating also serves to extend the anchoring system life by reducing oxidation.

Figure 2:
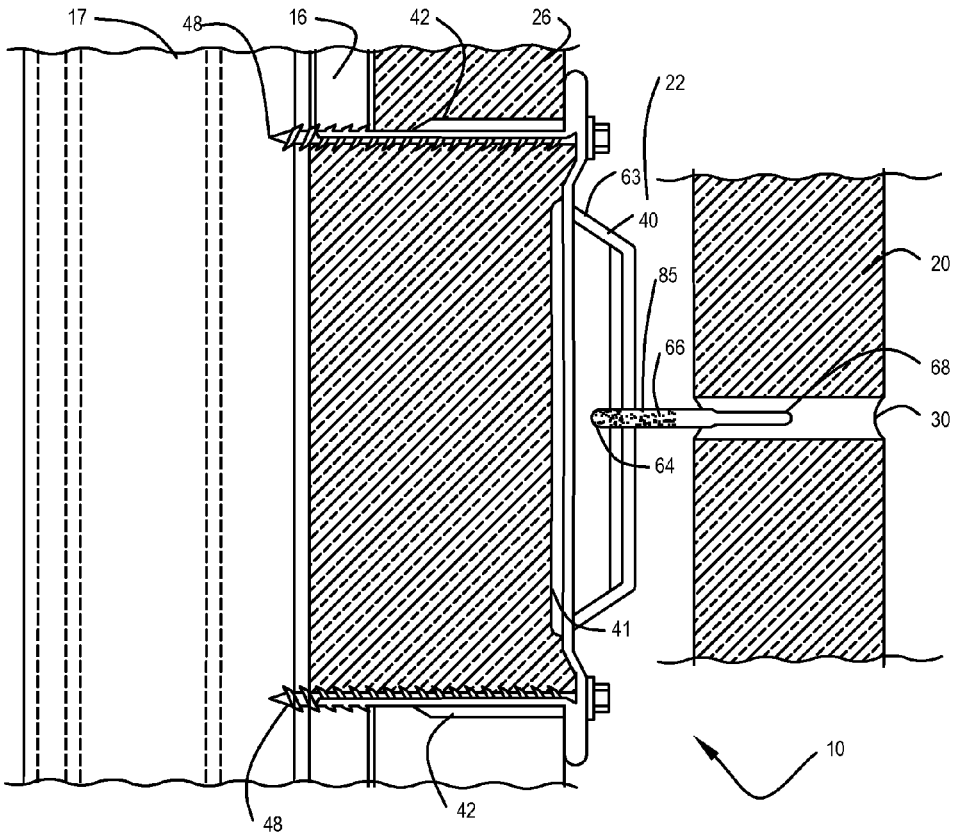
FIG. 2 is a cross sectional view in a yz-plane of FIG. 1 which shows the relationship of the surface-mounted anchoring system of this invention to the above-described dry-wall construction, and to the brick outer wythe, the veneer tie attachment portion is thermally-coated and the veneer tie insertion portion is compressively reduced.
Figure 3:
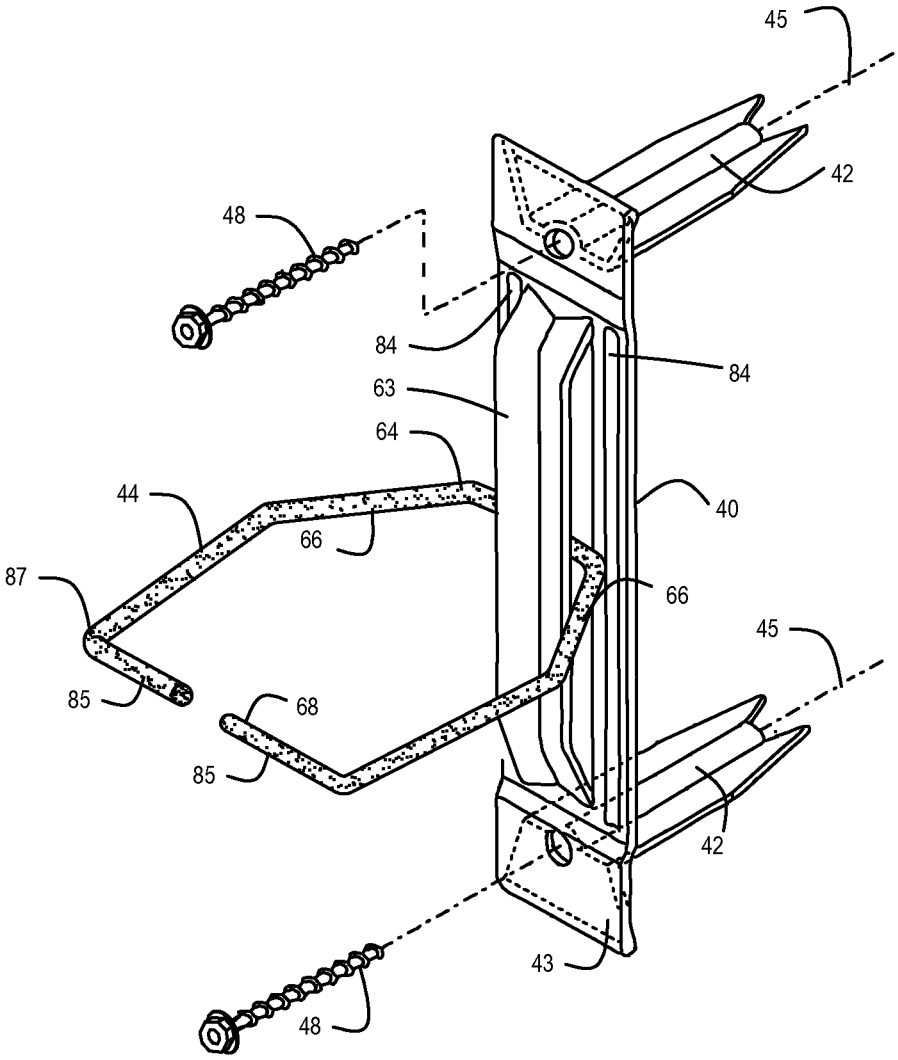
FIG. 3 is a perspective view of the surface-mounted anchoring system of FIG. 1 shown with a folded wall anchor and a thermally isolating veneer tie threaded therethrough.

Referring now to FIGS. 1 through 3, the first embodiment shows an anchoring system with a thermally-isolating veneer tie that provides an in-cavity thermal break. This system is suitable for recently promulgated standards and, in addition, has lower thermal transmission and conductivity values and greater resilience than the prior art anchoring systems. The system discussed in detail hereinbelow, has a notched, folded wall anchor (substantially similar to that of U.S. Pat. No. 7,587,874), and an interengaging thermally-isolating veneer tie. The wall anchor is surface mounted onto an externally insulated dry wall structure that with an optional waterproofing membrane (not shown) between the wallboard and the insulation. For the first embodiment, a cavity wall having an insulative layer of 2.5 inches (approx.) and a total span of 3.5 inches (approx.) is chosen as exemplary.

The surface-mounted anchoring system for cavity walls is referred to generally by the numeral 10. A cavity wall structure 12 is shown having an inner wythe or dry wall backup 14. Sheetrock or wallboard 16 is mounted on metal studs or columns 17 and an outer wythe or facing wall 18 is formed from brick 20 construction. Between the inner wythe 14 and the outer wythe 18, a cavity 22 is formed. The wallboard 16 has attached insulation 26.

Successive bed joints 30 and 32 are substantially planar and horizontally disposed and, in accord with building standards, are a predetermined 0.375-inch (approx.) in height. Selective ones of bed joints 30 and 32, which are formed between courses of bricks 20, are constructed to receive therewithin the insertion portion 68 of the veneer tie 44 of the anchoring system hereof. Being surface mounted onto the inner wythe 14, the anchoring system 10 is constructed cooperatively therewith and is configured to minimize air and moisture penetration around the wall anchor system/inner wythe juncture.

For purpose of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes, 34, 36. A folded wall anchor 40, constructed from a plate-like body, has a mounting face or surface 41 and an outer face or surface 43. The wall anchor 40 has a pair of legs 42 extending from the mounting surface 41 which penetrate the inner wythe 14. The pair of legs 42 have longitudinal axes 45 that are substantially normal to the mounting surface 41 and outer surface 43. The wall anchor 40 is a stamped metal construct which is constructed for surface mounting on the inner wythe 14 and for interconnection with the veneer tie 44. An apertured receptor portion 63 is adjacent to the outer surface 43 and dimensioned to interlock with the veneer tie 44.

The veneer tie 44 is a high-strength thermally-coated wire formative of a gage close to the receptor opening measured in an xz plane. The veneer tie 44 is shown in FIG. 1 as being emplaced on a course of bricks 20 in preparation for embedment in the mortar of bed joint 30. In this embodiment, the system includes a wall anchor 40 and a veneer tie 44.

At intervals along a horizontal line on the outer surface of insulation 26, the wall anchors 40 are surface mounted. In this structure, channels sheathe the interior of the pair of fasteners or mounting hardware 48. The folded wall anchors 40 are positioned on the outer surface of insulation 26 so that the longitudinal axis of a column 17 lies within the yz-plane formed by the longitudinal axes 45 of the pair of legs 42. Upon insertion in the inner wythe 14, the mounting surface 41 rests snugly against the opening formed thereby and serves to cover the opening, precluding the passage of air and moisture therethrough. This construct maintains the insulation integrity. The pair of legs 42 have the lower portion removed thereby forming notches which draw off moisture, condensate or water from the associated leg or hardware and serves to relieve any pressure which would drive toward the wallboard 16. This construct maintains the waterproofing integrity.

Optional strengthening ribs 84 are impressed in the wall anchor 40. The ribs 84 are substantially parallel to the apertured receptor portion 63 and, when mounting hardware 48 is fully seated so that the wall anchor 40 rests against the insulation 26, the ribs 84 are then pressed into the surface of the insulation 26. This provides additional sealing. While the ribs 84 are shown as protruding toward the insulation, it is within the contemplation of this invention that ribs 84 could be raised in the opposite direction. The alternative structure would be used in applications wherein the outer layer of the inner wythe is noncompressible and does not conform to the rib contour. The ribs 84 strengthen the wall anchor 40 and achieve an anchor with a tension and compression rating of 100 lbf.

The dimensional relationship between the wall anchor 40 and veneer tie 44 limits the axial movement of the construct. The veneer tie 44 is a thermally-coated wire formative. Each veneer tie 44 has an attachment portion 64 that interlocks with the veneer tie aperture receptor portion 63. The apertured receptor portion or receptor 63 is constructed, in accordance with the building code requirements, to be within the predetermined dimensions to limit the z-axis 38 movement and permit y-axis 36 adjustment of the veneer tie 44. The dimensional relationship of the attachment portion 64 to the apertured receptor portion 63 limits the x-axis movement of the construct. Contiguous with the attachment portion 64 of the veneer tie 44 are two cavity portions 66. An insertion portion 68 is contiguous with the cavity portions 66 and opposite the attachment portion 64.

Figure 4:
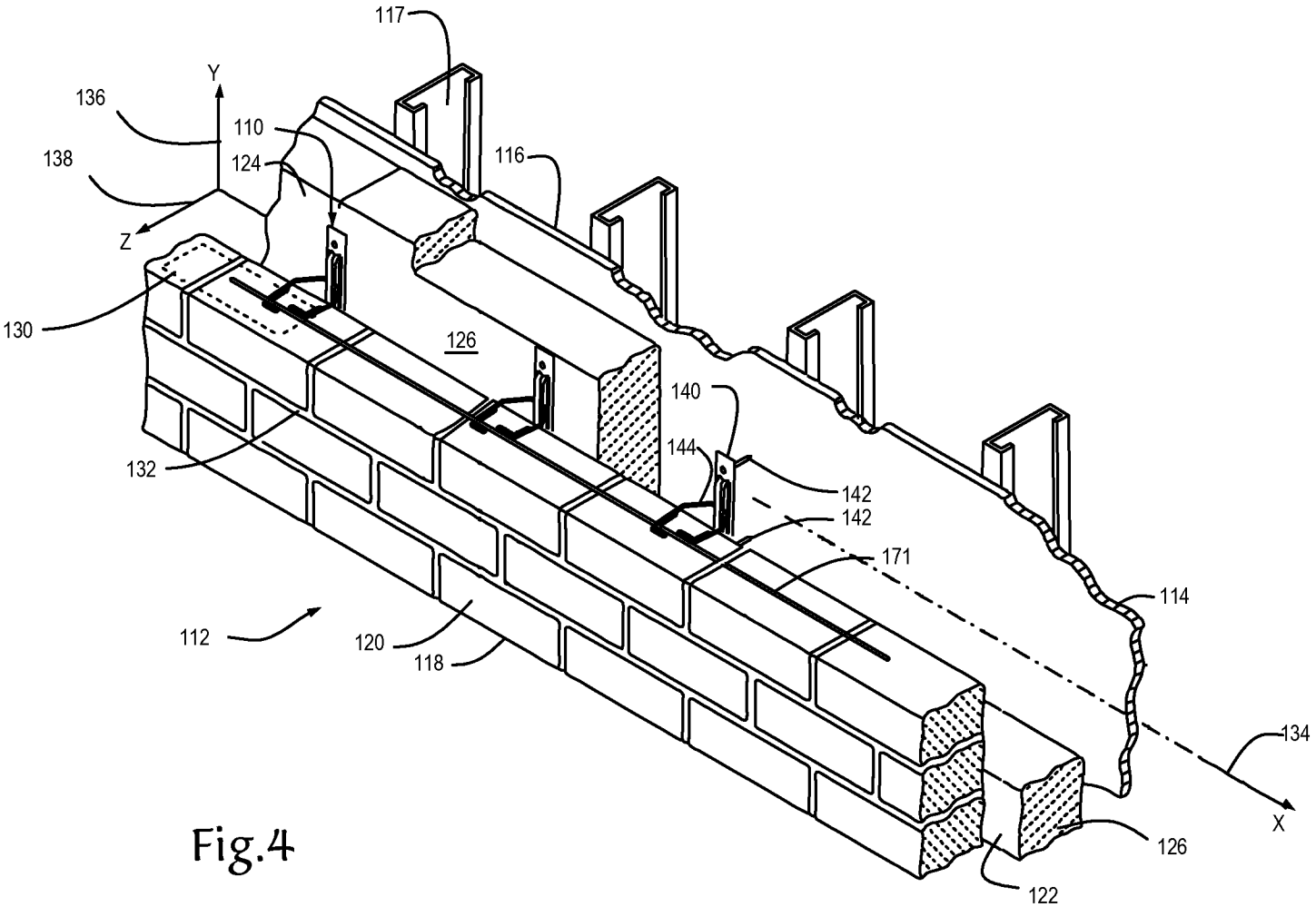
FIG. 4 is a perspective view of a second embodiment of this invention showing a surface-mounted anchoring system with a thermally isolating veneer tie for a seismic-resistant cavity wall and is similar to FIG. 1, but shows wall anchors with tubular legs and a swaged veneer tie accommodating a reinforcing wire in the bed joints of the brick outer wythe.
Figure 5:
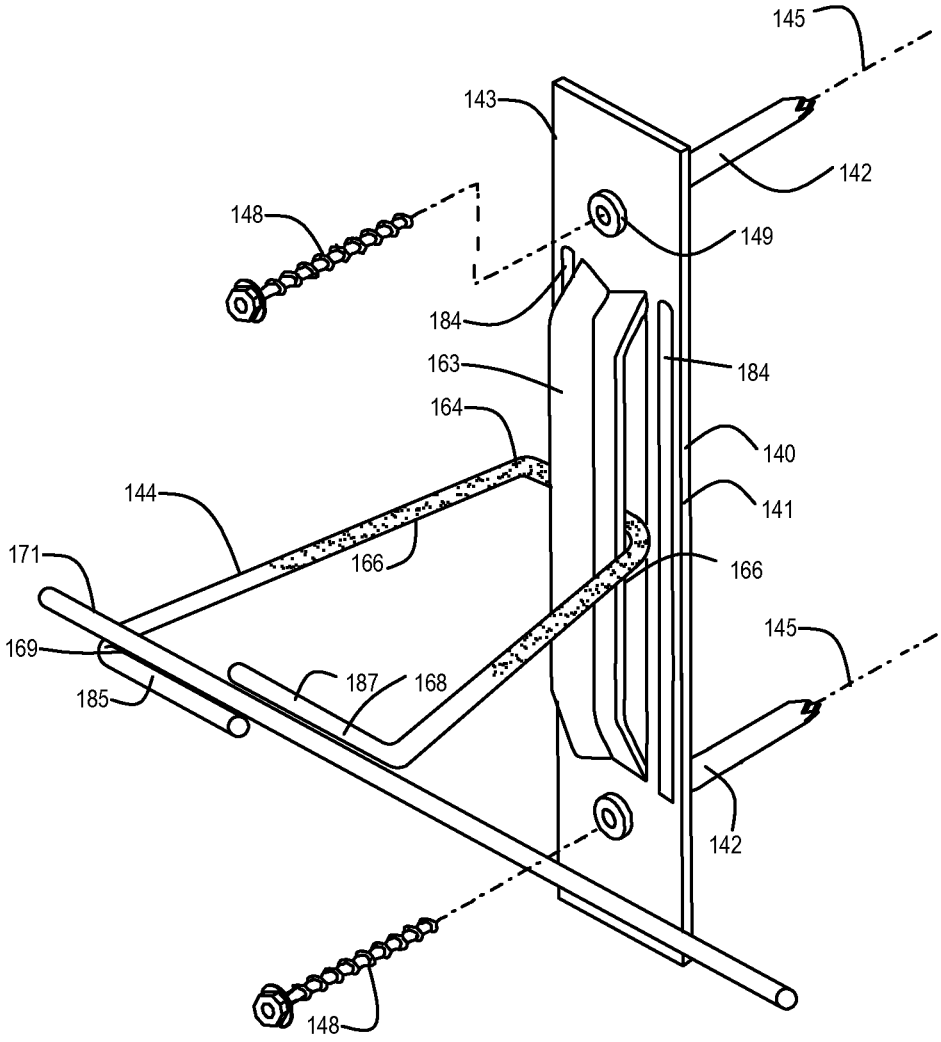
FIG. 5 is a perspective view showing the surface-mounted anchoring system having a wall anchor with notched tubular legs of FIG. 4, having a veneer tie with the attachment portion thermally-coated.

The insertion portion 68 is optionally compressively reduced in height to a combined height substantially less than the predetermined height of the bed joint 30 ensuring a secure hold in the bed joint 30 and an increase in the strength and pullout resistance of the veneer tie 44, as shown in FIGS. 1 and 2. Further to provide for a seismic construct, an optional compression or swaged indentation is provided in the insertion portion 68 to interlock in a snap-fit relationship with a reinforcement wire (as shown in FIGS. 4 and 5).

A thermally-isolating ceramic or ceramic-based coating or thermal coating 85 is applied to the attachment portion 64 of the veneer tie to provide a thermal break in the cavity. The thermal coating 85 is optionally disposed on the cavity portions 66 and/or the insertion portion 68 to provide ease of coating and additional thermal protection. The thermal coating 85 has low thermal conductivity and transmissivity with a K-value of the thermally-coated veneer tie 44 at a level that does not exceed 1.0 W/m K. The thermal coating 85 includes a ceramic topcoat comprised of ceramic beads 87 suspended in a base with binders. The ceramic beads 87 are selected from a group consisting of silica, zirconia, magnesium zirconate, yttria-stabilized zirconia, and derivatives and admixtures thereof. The thermal coating 85 has a thermal expansion substantially similar to the thermal expansion of the underlying wire formative attachment portion 64 to prevent cracking or flaking of the thermal coating. An exemplary thermal coating 85 is applied in layers including prime coat, where upon curing, the outer layers of the ceramic coating 85 are cross-linked to the prime coat to provide high-strength adhesion to the attachment portion 64 and/or the entire veneer tie 44.

The thermal coating 85 reduces the K-value and the U-value of the veneer tie. The wire formative components of the veneer tie are formed from materials which include, but are not limited to, mill galvanized, hot galvanized, and stainless steel. Such components have K-values that range from 16 to 116 W/m K. The thermal coating 85 reduces the K-value of the veneer tie 44 to not exceed 1.0 W/m K and the associated U-value to not exceed 0.35 $W/m^2K$. The thermal coating 85 is not combustible and gives off no toxic smoke in the event of a fire. Additionally, the thermal coating 85 provides corrosion protection which protects against deterioration of the anchoring system 10 over time.

The thermal coating 85 is applied through any number of methods including vapor deposition, spraying, hot dip processing, and similar processes, and includes both powder and fluid coating to form a reasonably uniform coating. A coating 85 having a thickness of at least about 5 micrometers is optimally applied. The thermal coating 85 is optionally applied in layers in a manner that provides strong adhesion to the attachment portion 64 and/or the entire veneer tie 44.

The description which follows is a second embodiment of the veneer tie and wall anchoring system providing an in-cavity thermal break in cavity walls. For ease of comprehension, wherever possible, similar parts use reference designators 100 units higher than those above. Thus, the veneer tie 144 of the second embodiment is analogous to the veneer tie 44 of the first embodiment. Referring now to FIGS. 4 and 5, the second embodiment of the surface-mounted anchoring system is shown and is referred to generally by the numeral 110. As in the first embodiment, a wall structure 112 is shown. The second embodiment has an inner wythe or backup wall 114 of dry wall construction with an optional waterproofing membrane (not shown) disposed thereon. Wallboard 116 is attached to columns or studs 117 and an outer wythe or veneer 118 of facing brick 120 is constructed. The inner wythe 114 and the outer wythe 118 have a cavity 122 therebetween. Here, the anchoring system has a surface-mounted wall anchor 140 with notched, tubular legs 142 and a swaged veneer tie 144 for receiving reinforcement wires 171 to create a seismic anchoring system.

The anchoring system 110 is surface mounted to the inner wythe 114. In this embodiment like the previous one, insulation 126 is disposed on the wallboard 116. Successive bed joints 130 and 132 are substantially planar and horizontally disposed and in accord with building standards set at a predetermined 0.375-inch (approx.) in height. Selective ones of bed joints 130 and 132, which are formed between courses of bricks 120, are constructed to receive therewithin the veneer tie of the anchoring system construct hereof. Being surface mounted onto the inner wythe, the anchoring system 110 is constructed cooperatively therewith, and as described in greater detail below, is configured to penetrate through the wallboard at a covered insertion point and to maintain insulation integrity.

For the purpose of discussion, the insulation surface 124 of the inner wythe 114 contains a horizontal line or x-axis 134 and an intersecting vertical line or y-axis 136. A horizontal line or z-axis 138, normal to the xy-plane, passes through the coordinate origin formed by the intersecting x- and y-axes, 136, 138. A wall anchor 140 constructed from a metal plate-like body is shown which has a pair of legs 142 that penetrate the inner wythe 114. Wall anchor 140 is a stamped metal construct which is constructed for surface mounting on the inner wythe 114 and for interconnection with the veneer tie 144 which, in turn, receives a reinforcement 171 therewithin.

The wall anchor is similar to that set forth in U.S. Pat. No. 7,587,874. The veneer tie 144 is shown in FIG. 5 as being emplaced on a course of bricks 120 in preparation for embedment in the mortar of bed joint 130. In this embodiment, the system includes a wall anchor 140, veneer reinforcement 171, and a swaged veneer tie 144. The veneer reinforcement 171 is constructed of a wire formative conforming to the joint reinforcement requirements of ASTM Standard Specification A951-00, Table 1, see supra.

At intervals along the inner wythe 114, wall anchors 140 are surface mounted. In this structure, the pair of legs 142 are tubular and sheathe the mounting hardware or fasteners 148. The hardware 148 is adapted to thermally isolate the wall anchor 140 with optional neoprene sealing washers 149. The wall anchors 140 are positioned on the inner wythe 114 so that the longitudinal axis of a column 117 lies within the yz-plane formed by the longitudinal axes 145 of the pair of legs 142. As best shown in FIG. 5, the pair of legs 142, when installed, lie in an xy-plane. The wall anchor 140 is constructed from a plate-like body, which has a mounting face or surface 141 and an outer face or surface 143. The wall anchor 140 has a pair of legs 142 extending from the mounting surface 141 which penetrate the inner wythe 114. The pair of legs 142 have longitudinal axes 145 that are substantially normal to the mounting and outer surface 141, 143. A pair of fasteners 148 are disposed adjacent to the pair of legs 142 and affix the wall anchor 140 to the inner wythe 114 An apertured receptor portion 163 is adjacent the outer surface 143 and dimensioned to interlock with the veneer tie 144 and limit displacement of the outer wythe 118 toward and away from the inner wythe 114.

The wall anchor 140 rests snugly against the opening formed thereby and serves to cover the opening, precluding the passage of air and moisture therethrough, thereby maintaining the insulation 126 integrity. It is within the contemplation of this invention that a coating of sealant or a layer of a polymeric compound—such as a closed-cell foam—(not shown) be placed on mounting surface 141 for additional sealing. Optionally, a layer of Textroseal® sealant or equivalent (not shown) distributed by Hohmann & Barnard, Inc., Hauppauge, N.Y. 11788 may be applied under the mounting surface 141 for additional protection.

In this embodiment, as best seen in FIG. 5, strengthening ribs 184 are impressed in wall anchor 140. The ribs 184 are substantially parallel to the apertured receptor portion 163 and when mounting hardware 148 is fully seated, the wall anchor 140 rests against the insulation 126. The ribs 184 strengthen the wall anchor 140 and achieve an anchor with a tension and compression rating of 100 lbf.

The legs 142 of wall anchor 140 are notched so that the depths thereof are slightly greater than the wallboard 116 and optional waterproofing membranes (not shown) thicknesses. The notch excesses form small wells which draw off moisture, condensate or water by relieving any pressure that would drive toward wallboard 116. This construct maintains the waterproofing integrity.

The dimensional relationship between wall anchor 140 and veneer tie 144 limits the axial movement of the construct. The veneer tie 144 is a high-strength thermally-coated wire formative. Each veneer tie 144 has an attachment portion 164 that interengages with the apertured receptor portion 163. The apertured receptor portion 163 is constructed, in accordance with the building code requirements, to be within the predetermined dimensions to limit the z-axis 138 movement and permit y-axis 136 adjustment of the veneer tie 144. The dimensional relationship of the attachment portion 164 to the apertured receptor portion 163 limits the x-axis movement of the construct and prevents disengagement from the anchoring system. Contiguous with the attachment portion 164 of the veneer tie 144 are two cavity portions 166. An insertion portion 168 is contiguous with the cavity portions 166 and opposite the attachment portion 164.

The insertion portion 168 is optionally compressively reduced in height to a combined height substantially less than the predetermined height of the bed joint 130 ensuring a secure hold in the bed joint 130 and an increase in the strength and pullout resistance of the veneer tie 144. Further to provide for a seismic construct, a compression or swaged indentation 169 is provided in the insertion portion 168 to interlock in a snap-fit relationship with a reinforcement wire 171.

A thermally-isolating ceramic or ceramic-based coating or thermal coating 185 is applied to the attachment portion 164 of the veneer tie 144 to provide a thermal break in the cavity 122. The thermal coating 185 is optionally applied to the cavity portions 166 and/or the insertion portion 168 to provide ease of coating and additional thermal protection. The thermal coating 185 has low thermal conductivity and transmissivity with a K-value of the thermally-coated veneer tie at a level that does not exceed 1.0 W/m K. The thermal coating 185 includes a ceramic topcoat comprised of ceramic beads 187 suspended in a base with binders. The ceramic beads 187 are selected from a group consisting of silica, zirconia, magnesium zirconate, yttria-stabilized zirconia, and derivatives and admixtures thereof. The thermal coating 185 has a thermal expansion substantially similar to the thermal expansion of the wire formative attachment portion 164 to prevent cracking or flaking of the thermal coating. An exemplary thermal coating 185 is applied in layers including a prime coat, where upon curing, the outer layers of the ceramic coating 185 are cross-linked to the prime coat to provide high-strength adhesion to the attachment portion 164 and/or the other portions of the veneer tie 166, 168.

The thermal coating 185 reduces the K-value and the U-value of the veneer tie. The veneer tie wire formative components are selected from mill galvanized, hot galvanized, stainless steel, and similar materials. Such components have K-values that range from 16 to 116 W/m K. The thermal coating 185 reduces the K-value of the veneer tie 144 to not exceed 1.0 W/m K and the associated U-value to not exceed 0.35 W/m$^2$K. The thermal coating 185 is not combustible and gives off no toxic smoke in the event of a fire. Additionally, the thermal coating 185 provides corrosion protection which protects against deterioration of the anchoring system 110 over time.

The thermal coating 185 is applied through any number of methods including vapor deposition, spraying, hot dip processing, and similar processes, and includes both powder and fluid coating to form a reasonably uniform coating. A coating 185 having a thickness of at least about 5 micrometers is optimally applied. The thermal coating 185 is applied in layers in a manner that provides strong adhesion to the attachment portion 164 and/or the other portions of the veneer tie 166, 168.

Figure 6:
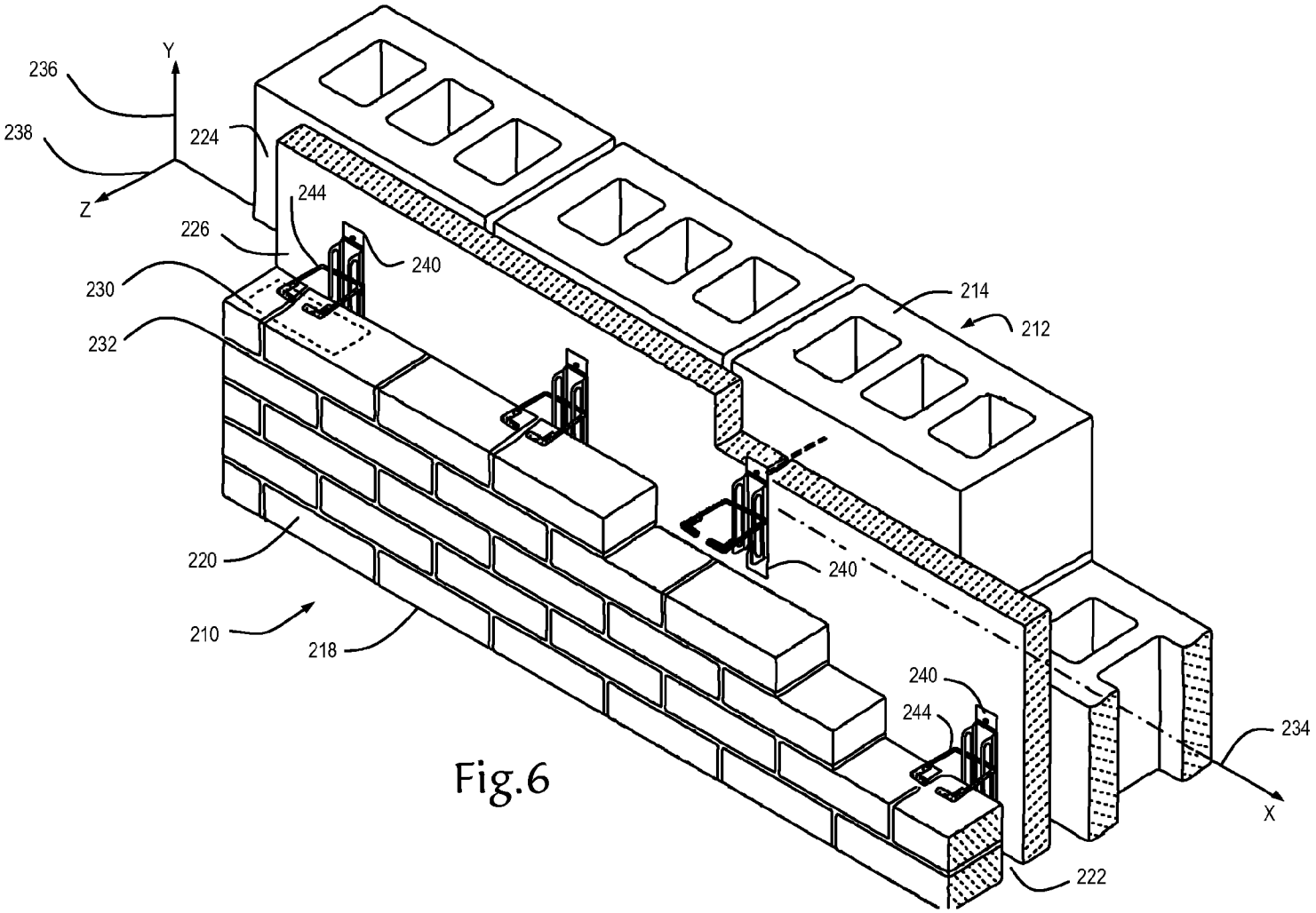
FIG. 6 is a perspective view of a third embodiment of this invention showing a surface-mounted anchoring system with a thermally isolating veneer tie for a cavity wall having an inner wythe of masonry blocks with insulation thereon, and is similar to FIG. 1, but shows a system employing a notched, folded wall anchor, the veneer tie is thermally-coated and the veneer tie insertion portion is compressively reduced; and, FIG. 7 is a perspective view showing the wall anchor of FIG. 6 having channels for ensheathing the exterior of the mounting hardware and the corresponding veneer tie with a thermally-coated attachment portion.
Figure 7:
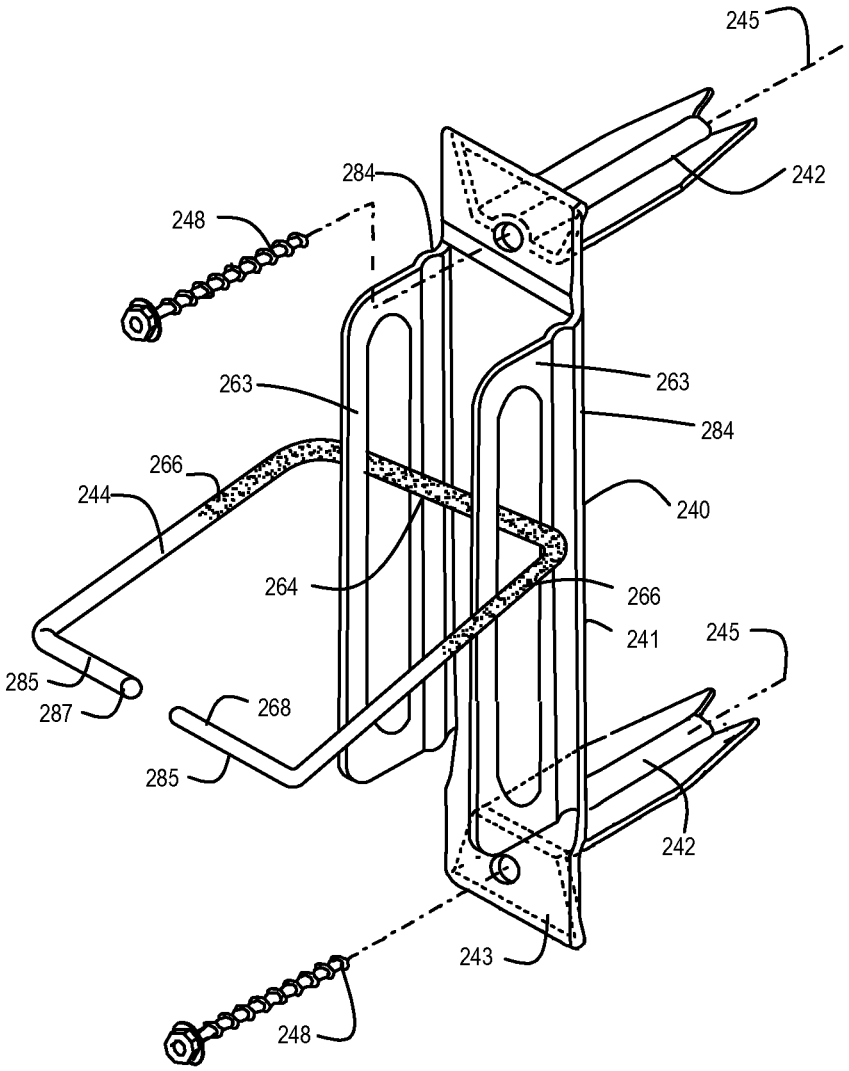

The description which follows is a third embodiment of the veneer tie and wall anchoring system providing for an in-cavity thermal break in cavity walls. For ease of comprehension, wherever possible similar parts use reference designators 100 units higher than those above. Thus, the veneer tie 244 of the third embodiment is analogous to the veneer tie 144 of the second embodiment. Referring now to FIGS. 6 and 7, the third embodiment of the surface-mounted anchoring system is shown and is referred to generally by the numeral 210. As in the previous embodiments, a wall structure 212 is shown. Here, the third embodiment has an inner externally insulated, inner wythe or masonry structure 214. The structure includes insulation 226 disposed on masonry blocks 224 and an outer wythe or veneer 218 of facing brick 220. The inner wythe 214 and the outer wythe 218 have a cavity 222 therebetween. The anchoring system has a notched, surface-mounted wall anchor 240 with slotted wing portions or an apertured receptor portion 263 for receiving the veneer tie 244.

The anchoring system 210 is surface mounted to the inner wythe 214 by a pair of fasteners 248. Insulation 226 is disposed on the masonry blocks 224. The outer wythe 218 contains successive bed joints 230 and 232 which are substantially planar and horizontally disposed and in accord with building standards and are set at a predetermined 0.375-inch (approx.) in height. Selective ones of bed joints 230 and 232, which are formed between courses of bricks 220, are constructed to receive therewithin the veneer tie 244 of the anchoring system construct hereof. Being surface mounted onto the inner wythe 214, the anchoring system 210 is constructed cooperatively therewith, and as described in greater detail below, is configured to penetrate through the insulation at a covered insertion point to maintain insulation integrity.

For purposes of discussion, the surface of the insulation 226 contains a horizontal line or x-axis 234 and an intersecting vertical line or y-axis 236. A horizontal line or z-axis 238, normal to the xy-plane, passes through the coordinate origin formed by the intersecting x- and y-axes, 236, 238. A folded wall anchor 240 is shown which has a pair of legs 242 which penetrate the inner wythe 214. The wall anchor 240 is a stamped metal construct which is constructed for surface mounting on the inner wythe 214 and for interconnection with the veneer tie 244. The wall anchor 240 is constructed from a plate-like body, which has a mounting face or surface 241 and an outer face or surface 243. The wall anchor 240 has a pair of legs 242 extending from the mounting surface 241 which penetrate the inner wythe 214. The pair of legs 242 have longitudinal axes 245 that are substantially normal to the mounting surface 241 and outer surface 243. An apertured receptor portion 263 is adjacent the outer surface 243 and dimensioned to interlock with the veneer tie 244 and limit displacement of the outer wythe 218 toward and away from the inner wythe 214. Upon insertion of the anchor 240 in the insulation 226, the mounting surface 214 rests snugly against the opening formed by the legs 242 and serves to cover the opening, precluding the passage of air and moisture therethrough, thereby maintaining the insulation integrity. The wall anchor 240 is similar to that shown in U.S. Pat. No. 7,587,874.

The pair of legs 242 of wall anchor 240 are notched at the insertion end to form small wells which draw off moisture condensate, or water and relieves pressure that would drive the same toward the inner wythe 214. With this structure, the waterproofing integrity is maintained. In this embodiment, as best seen in FIG. 7, strengthening ribs 284 are impressed into the apertured receptor portion 263 parallel to the mounting surface 241 of wall anchor 240. The ribs 284 strengthen the wall anchor 240 and achieve an anchor with a tension and compression rating of 100 lbf.

The dimensional relationship between the wall anchor 240 and the veneer tie 244 limits the axial movement of the construct. The veneer tie 244 is a thermally-coated wire formative. Each veneer tie 244 has an attachment portion 264 that interengages with the apertured receptor portion 263. The apertured receptor portion 263 is constructed, in accordance with the building code requirements, to be within the predetermined dimensions to limit the z-axis 238 movement and permit y-axis 236 adjustment of the veneer tie 244. The dimensional relationship of the attachment portion 264 to the apertured receptor portion 263 limits the x-axis 236 movement of the construct and prevents disengagement from the anchoring system 210. Contiguous with the attachment portion 264 of the veneer tie 244 are two cavity portions 266. An insertion portion 268 is contiguous with the cavity portions 266 and opposite the attachment portion 264.

The insertion portion 268 is optionally compressively reduced in height to a combined height substantially less than the predetermined height of the bed joint 230 (see FIG. 6) ensuring a secure hold in the bed joint 230 and an increase in the strength and pullout resistance of the veneer tie 244. Further to provide for a seismic construct, a compression (as shown in FIG. 5) is optionally provided in the insertion portion 268 to interlock with a reinforcement wire (not shown).

A thermally-isolating ceramic or ceramic-based coating or thermal coating 285 is applied to the attachment portion 264 of the veneer tie 244 to provide a thermal break in the cavity 222. The thermal coating 285 is optionally applied to the cavity portions 266 and/or the insertion portion 268 to provide ease of coating and additional thermal protection. The thermal coating 285 has low thermal conductivity and transmissivity with a K-value of the thermally-coated veneer tie 244 at a level that does not exceed 1.0 W/m K. The thermal coating 285 includes a ceramic topcoat comprised of ceramic beads 287 suspended in a base with binders. The ceramic beads 287 are selected from a group consisting of silica, zirconia, magnesium zirconate, yttria-stabilized zirconia, and derivatives and admixtures thereof. The thermal coating 285 has a thermal expansion substantially similar to the thermal expansion of the wire formative attachment portion 264 to prevent cracking or flaking of the thermal coating. An exemplary thermal coating 285 is applied in layers including a prime coat, where upon curing, the outer layers of the ceramic coating 285 are cross-linked to the prime coat to provide high-strength adhesion to the attachment portion 264 and/or the entire veneer tie 244 to resist chipping or wearing of the thermal coating 285.

The thermal coating 285 reduces the K-value and the U-value of the veneer tie. The wire formative components are formed from materials which include, but are not limited to, mill galvanized, hot galvanized, and stainless steel. Such components have K-values that range from 16 to 116 W/m K. The thermal coating 285 reduces the K-value of the veneer tie 244 to not exceed 1.0 W/m K and the associated U-value to not exceed 0.35 $W/m^2K$. The thermal coating 285 is not combustible and gives off no toxic smoke in the event of a fire. Additionally, the thermal coating 285 provides corrosion protection which protects against deterioration of the anchoring system 210 over time.

The thermal coating 285 is applied through any number of methods including vapor deposition, spraying, hot dip processing and similar processes, and includes both powder and fluid coating to form a reasonably uniform coating. A coating 285 having a thickness of at least about 5 micrometers is optimally applied. The thermal coating 285 is optionally applied in layers in a manner that provides strong adhesion to the attachment portion 264, and/or the other portions of the veneer tie 266, 268.

As shown in the description and drawings, the present invention serves to thermally isolate the components of the anchoring system reducing the thermal transmission and conductivity values of the anchoring system to low levels. The novel coating provides an insulating effect that is high-strength and provides an in-cavity thermal break, severing the thermal threads created from the interlocking anchoring system components.

In the above description of the anchoring systems of this invention various configurations are described and applications thereof in corresponding anchoring systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength veneer tie for use with an anchoring system in a wall having an inner wythe and an outer wythe, the outer wythe formed from a plurality of successive courses with a bed joint, having a predetermined height, between each two adjacent courses, the inner wythe and the outer wythe in a spaced apart relationship the one with the other forming a cavity therebetween, the veneer tie comprising:

a wire formative insertion portion for disposition in the bed joint of the outer wythe;

two wire formative cavity portions contiguous with the insertion portion;

a wire formative attachment portion contiguous with each of the two cavity portions and opposite the insertion portion, the attachment portion being adapted for interengagement with a receptor of a wall anchor; and, a thermally-isolating ceramic coating disposed only on the attachment portion, the coating having low thermal conductivity and transmissivity, the coating being adapted to form a thermal break in the cavity;

wherein upon installation within the anchoring system in the cavity wall, the veneer tie restricts thermal transfer between the veneer tie and the wall anchor and between the wall anchor and the veneer tie.

2. The veneer tie according to claim 1, wherein the thermally-isolating coating has a thermal expansion substantially similar to the thermal expansion of the wire formative attachment portion.

3. The veneer tie according to claim 2, wherein the coating includes a topcoat comprised of ceramic beads suspended in a base with binders.

4. The veneer tie according to claim 3, wherein the ceramic beads are selected from a group consisting of silica, zirconia, magnesium zirconate, yttria-stabilized zirconia, and derivatives and admixtures thereof.

5. The veneer tie according to claim 2, wherein the coating is applied in layers including a prime coat; and wherein, upon curing, the outer layers of the coating are cross-linked to the prime coat to provide high-strength adhesion to the attachment portion.

6. The veneer tie according to claim 4, wherein the coating reduces the K-value of the veneer tie to a level not to exceed 1.0 W/m K.

7. A surface-mounted anchoring system for use in the construction of a wall having an inner wythe and an outer wythe, the outer wythe formed from a plurality of successive courses with a bed joint, having a predetermined height, between each two adjacent courses, the inner wythe and the outer wythe in a spaced apart relationship the one with the other forming a cavity therebetween, the anchoring system comprising:

a wall anchor adapted to be fixedly attached to the inner wythe constructed from a plate-like body having two major faces being the mounting surface and the outer surface, the wall anchor, in turn, comprising;

a pair of legs for insertion in the inner wythe, the pair of legs extending from the mounting surface of the plate-like body with the longitudinal axes of the pair of legs being substantially normal to the two major faces; and, an apertured receptor portion adjacent the outer surface of the plate-like body;

a wire formative veneer tie having an attachment portion for interengagement with the apertured receptor portion;

a thermally-isolating ceramic coating with low thermal conductivity and transmissivity disposed only on the attachment portion, the coating having a thermal expansion substantially similar to the thermal expansion of the veneer tie; and, a pair of fasteners for disposition adjacent the anchor pair of legs affixing the wall anchor to the inner wythe.

8. The anchoring system according to claim 7, wherein the ceramic coating includes a topcoat comprised of ceramic beads suspended in a base with binders.

9. The anchoring system according to claim 8, wherein the ceramic beads are selected from a group consisting of silica, zirconia, magnesium zirconate, yttria-stabilized zirconia, and derivatives and admixtures thereof.

10. The anchoring system according to claim 7, wherein the ceramic coating reduces the K-value of the veneer tie to a level not to exceed 1.0 W/m K.

11. The anchoring system according to claim 7, wherein the veneer tie further comprises:

two cavity portions contiguous with the attachment portion; and, an insertion portion for disposition in the bed joint of the outer wythe, the insertion portion contiguous with the two cavity portions and opposite the attachment portion.

12. The veneer tie according to claim 10, wherein the coating comprises a matte finish and the veneer tie insertion portion is selectively and compressibly reduced in height to a combined height substantially less than the predetermined height of the bed joint enabling the veneer tie to securely hold to the bed joint and increase the strength and pullout resistance thereof.

13. The anchoring system according to claim 12, wherein the veneer tie insertion portion further comprises:

a swaged indentation dimensioned for a snap-fit relationship with a reinforcement wire; and a reinforcement wire disposed in the swaged indentation;

whereby upon insertion of the reinforcement wire in the swaged indentation a seismic construct is formed.

14. A surface-mounted anchoring system for use in the construction of a wall having an inner wythe and an outer wythe, the outer wythe formed from a plurality of successive courses with a bed joint, having a predetermined height, between each two adjacent courses, the inner wythe and the outer wythe in a spaced apart relationship the one with the other forming a cavity therebetween, the inner wythe having wallboard mounted on columns and an exterior layer of insulation, the anchoring system comprising:

a wall anchor adapted to be fixedly attached to the inner wythe constructed from a metal plate-like body having two major faces being a mounting surface and an outer surface, the wall anchor, in turn, comprising;

a pair of legs each extending from the mounting surface of the plate-like body with the longitudinal axis of each of the legs being substantially normal to the mounting surface, the legs configured for insertion into the inner wythe; and, an apertured receptor portion adjacent the outer surface of the plate-like body, the apertured receptor portion configured to limit displacement of the outer wythe toward and away from the inner wythe;

a wire formative veneer tie interlockingly connected with the apertured receptor portion and configured for embedment in the bed joint of the outer wythe to prevent disengagement from the anchoring system, the veneer tie further comprising:

an insertion portion for disposition in the bed joint of the outer wythe;

two cavity portions contiguous with the insertion portion;

an attachment portion contiguous with the cavity portions and opposite the insertion portion;

a thermally-isolating ceramic coating disposed only on the insertion portion, the cavity portions, and the attachment portion, the coating having low thermal conductivity transmissivity and a thermal expansion substantially similar to the thermal expansion of the veneer tie; and, a pair of fasteners for disposition adjacent the wall anchor pair of legs affixing the wall anchor to the inner wythe.

15. The anchoring system according to claim 14, wherein the coating includes a topcoat comprised of ceramic beads suspended in a base with binders.

16. The anchoring system according to claim 15, wherein the ceramic beads are selected from a group consisting of silica, zirconia, magnesium zirconate, yttria-stabilized zirconia, and derivatives and admixtures thereof.

17. The anchoring system according to claim 16, wherein the coating reduces the K-value of the veneer tie to a level not to exceed 1.0 W/m K.

18. The anchoring system according to claim 17, wherein the coating is applied in layers including a prime coat; and wherein, upon curing, the outer layers of the coating are cross-linked to the prime coat to provide high-strength adhesion to the veneer tie attachment portion.

19. The anchoring system according to claim 14, wherein the coating comprises a matte finish and the veneer tie insertion portion is selectively and compressibly reduced in height to a combined height substantially less than the predetermined height of the bed joint enabling the veneer tie to securely hold to the bed joint and increase the strength and pullout resistance thereof.

* * * * *